United States Patent [19]

Hack et al.

[11] 4,035,204

[45] July 12, 1977

[54] METHOD OF CARBURIZING THE INNER SURFACE OF A STEEL VALVE SEAT

[75] Inventors: Josef Hack, Leinfelden; Bruno Schäfer, Ludwigsburg, both of Germany

[73] Assignee: Robert Bosch G.m.b.H., Stuttgart, Germany

[21] Appl. No.: 621,019

[22] Filed: Oct. 9, 1975

[30] Foreign Application Priority Data

Oct. 30, 1974 Germany ..... 2451536

[51] Int. Cl.[2] ..... C21D 1/26

[52] U.S. Cl. ..... 148/19; 123/188 S; 148/31.5

[58] Field of Search ..... 148/16.5, 16.6, 19, 148/31.5; 123/188 S

[56] References Cited

U.S. PATENT DOCUMENTS

| | | | |
|---|---|---|---|
| 2,410,060 | 10/1946 | Goodale | 148/11.5 F |
| 3,313,660 | 4/1967 | Vordahl | 148/127 |
| 3,499,803 | 3/1970 | Henrickson et al. | 148/16.5X |
| 3,567,528 | 3/1971 | Mohling | 148/39 |
| 3,837,931 | 9/1974 | Nemoto et al. | 148/39 |

*Primary Examiner*—Arthur J. Steiner
*Attorney, Agent, or Firm*—William R. Woodward

[57] ABSTRACT

To carburize the inner surface of hollow, narrow work pieces, such as valve seats in blind bores, and avoid the use of salt baths which have residues containing Prussic acid, a mandrel is made fitting with little clearance in the order of 0.1 mm into the blind bore, and having a carbon content in the range in which carbon is yielded which is higher than the carbon content of the work piece to be carburized, the mandrel or carburizing element having a surface which fits or matches the surface of the work piece with the clearance. The work piece and the carburizing element are heated to carburizing, incandescent temperature and the carburizing element is removed from the work piece after carburizing thereof.

7 Claims, 5 Drawing Figures

METHOD OF CARBURIZING THE INNER SURFACE OF A STEEL VALVE SEAT

The present invention relates to a method to carburize at least the surface portion of steel work pieces by heating the work piece in the presence of substances yielding carbon, while heating the work piece to carburizing temperature, that is, typically to red heat or incandescence.

It is known to carburize the outer surfaces of steel work pieces by making the work piece initially of a steel having low carbon content and surrounding the work piece with a powder yielding carbon. The work piece is then placed in a closed steel container or furnace, sealed airtight, and heated for several hours to at least 720° C. As a result, carbon from the powder surrounding the work piece enters the steel work piece in gaseous stage. The depth of penetration depends on the time during which the work pieces are carburized in the presence of carbon. Other substances than carbon powder -as gases -which are yielding carbon can be used to carburize work pieces.

The described method is well suited to carburize the outer exposed surfaces of work pieces; to carburize inner surfaces, or re-entrant surfaces in work pieces, the described method can be used if the inner surfaces are continuous, that is, do not form blind bores, have wide cross section, and are not deep, and fit at their ends to the outer surfaces likewise being carburized.

It is also known to carburize the inner surfaces of work pieces by carburizing the work pieces in a salt bath. The bath contains a salt which contains carbon and yields the carbon to the work piece during the carburizing process, that is, during heating. The work pieces are heated in the salt bath and thus carburized.

Salt baths to carburize the inner surfaces of work pieces permit good carburizing of various types of surfaces, even inner surfaces which are in narrow or long blind bores. The salt bath method has one serious disadvantage, however: The bath which yields the carbon contains sodium cyanide. This substance forms Prussic acid, that is, hydrocyanic acid which, as is known, is a very dangerous poison.

It is necessary to carefully and extensively wash the work pieces after hardening in order to prevent poisoning by hydrocyanic acid. The wash water, as well as the salt bath remnants which are no longer used, must be treated with lye and chlorine in such a manner that neither effluents from the process, nor storage places for the salt are poisoned.

It is an object of the present invention to provide a method to carburize the surfaces of steel work pieces in which also inner surfaces forming, for example, blind bores of long and narrow dimensions may be suitably carburized, particularly blind bores of nozzle structures used in fuel injection valves for internal combustion engines. The carburization process should effect a uniformly carburized surface and, in accordance with the object of the invention, should not require the use of materials which are toxic, or which generate poisons in the atmosphere, in water, or upon storage.

SUBJECT MATTER OF THE PRESENT INVENTION

Briefly, a shaped body having an outer surface configuration which matches approximately the bore, the surface of which is to be carburized, is provided, the body having a carbon content which is higher in the range in which carbon is yielded than the carbon content of the work piece to be carburized. The shaped body or element is associated with the work piece to be carburized and, after carburization, that is, after heating to red or incandescent temperature, can readily be separated from the work piece. The shaped element or body can therefore be used to carburize work pieces in mass production processes. Preferably, the carburization body or element is just slightly smaller than the inner diameter of the bore, the surface of which is to be carburized, a suitable clearance being about 0.1 mm.

When carburizing the inner surfaces of valve structures, the body is preferably formed as a mandrel, or pin, having a cross section which is just slightly less than the corresponding cross section of the bore. The clearance between the element and the surface to be carburized permits penetration of carbon from the shaped body, in gaseous stage, into the surface of the work piece to be carburized.

The shaped body may be made of an iron alloy, graphite, or steel. Grey cast iron, steel, and iron alloys are inexpensive in raw material form and are easily shaped by machinery present in any metal working shop. Steel, grey cast iron and graphite have the outstanding advantage of being non-toxic.

The invention will be described by way of example with reference to the accompanying drawings, wherein.

Figure 1:
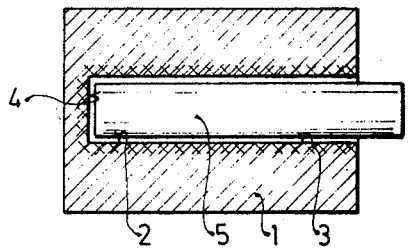
FIG. 1 is a highly schematic cross-sectional view of a cylindrical work piece having a cylindrical blind bore, with a carburizing element inserted therein.

The basic concept of the invention will be described in connection with FIG. 1, in which a work piece 1, of steel, is formed with a cylindrical blind bore 2. It is intended to carburize the inner surfaces 3, 4 of the bore 2 in the region indicated by the cross marks in FIG. 1.

Prior to carburization, the work piece 1 has a carbon content of 0.15 %. A cylindrical mandrel, or pin 5 is inserted in the blind bore. The diameter of mandrel 5 is smaller by 0.2 mm than the clear diameter of bore 2. The length of the mandrel is somewhat longer than the depth of the bore, to permit holding the end thereof, for example is longer than the depth of the bore by the diameter thereof. It is spaced from the end surface 4 by a clearance similar to the wall clearance, that is, about 0.1 mm. The mandrel 5 is located coaxially in the blind bore 2.

The end of the pin 5 projecting beyond the outer edge of work piece 1 is used to grip the pin or mandrel 5, so that the mandrel can be inserted, with the clearance dimensions of about 0.1 mm between the surface thereof and the inner surface of the bore, and to permit ready removal of the pin 5 from bore 2 after the carburization process.

The carbon content of mandrel 5 can readily be determined, since the carbon content of the surface of the carburized work piece will be the arithmetic mean of the carbon content of the work piece before carburization and the carbon content of the mandrel before carburization, mathematically:

$$C_k = (C_o + C_D)/2 \quad (1)$$

in which $C_o$ is carbon content of the work piece before carburization, in percent; $C_D$ is carbon content of the mandrel or carburizing element before carburization, in percent; and $C_K$ is carbon content of the work piece after carburization, in percent.

Reverting again to FIG. 1, the work piece 1 has a carbon content $C_o$ of 0.15%; the mandrel a carbon content of 1.1%; substituting:

$$C_k = (0.15 + 1.10)/2 = 0.625\% \text{ carbon} \quad (2)$$

Transfer of carbon from mandrel 5 to work piece 1 terminates when there is equilibrium or balance in the carbon content of the surface of the work piece 1 which is equal to the carbon content of the surface of the work piece 5 which yields or delivers the carbon, in the example at 0.625%.

Figure 2:
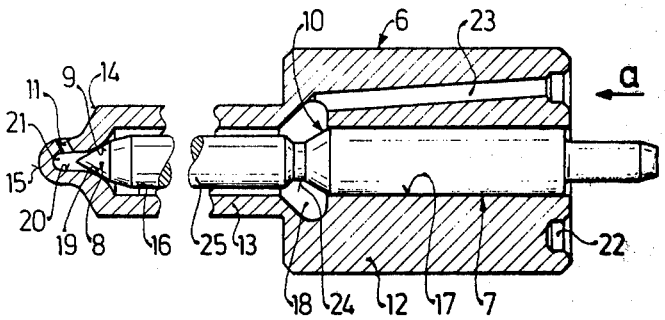
FIG. 2 is a fragmentary, part cut away longitudinal cross-sectional view through a fuel injection valve for internal combustion engines, having a blind bore, and illustrating the injection valve needle, schematically, in plan view.
Figure 3:
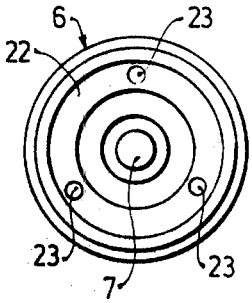
FIG. 3 is an end view of the body of FIG. 2, looked at in the direction of arrow a of FIG. 2.

A principal practical application of the process in accordance with the present invention is to harden or carburize the inner surfaces of nozzles used in automotive fuel injection systems. Referring to FIGS. 2 and 3: A fuel injection valve body 6 is formed with a valve seat 9 at the tip end thereof. A valve needle 7 is received in a central bore to fit against the valve surface 9. The valve body 6 simultaneously forms an injection nozzle, to inject pressurized fuel into the cylinder of an internal combustion engine, for example to inject Diesel fuel into the cylinder of diesel engine. The valve needle 7 is formed with a conical tip 8 which, when the valve is closed, fits on the valve seat 9 formed on the body 6, and is held in closed position by means of a spring (not shown). When fuel is to be injected, the valve needle 7 is lifted off the valve seat by the pressure of fluid acting on a ring surface 10 formed on the shaft of the needle, to lift the valve needle 7 counter the force of the spring (not shown) and off the seat 9 in valve body 6. Fuel can then enter the cylinder through three nozzle openings 11 formed in the forward part of the body 6, to be injected into the combustion space of the Diesel engine.

The fuel injection valve has a specific shape; considering the valve body from right to left, valve body 6 (FIG. 2) first has a thick cylindrical section 12, then a thinner cylindrical section 13 and finally a short tip 14, generally shaped like a truncated cone, which terminates in a final rounded end 15 which is semi-spherical and forms the tip end of the fuel injection body 6. The three injection nozzles or injection openings 11 to inject the liquid fuel into the combustion chamber of the engine are located at the semi-spherical tip 15.

The fuel injection body 6 is formed with a central bore 16 in which the valve needle 7 fits. This bore, looked at from the right to the left (FIG. 2) has various sections: first, a long cylindrical section 17 which is interrupted, about at the midpoint, by a ring duct 18. Duct 18, in cross section, is approximately semi-circular. A short funnel-shaped section 19 follows the long cylindrical portion 17. A very narrow cylindrical portion 20 follows the funnel-shaped portion 19 of rapidly decreasing diameter, the cylindrical portion terminating at the inner end in an essentially semi-spherical portion 21, having a diameter which is equal to that of the narrow cylindrical portion 20. A ring groove 22 is formed at the rear end face of the body 6. The ring groove 22 has approximately U-shaped cross section. Three inclined bores 23, spaced uniformly about the circumference of the ring groove 22, that is, at angles of 120° with respect to each other, connect the ring groove 22 with the ring duct 18 which, in turn, communicates with space 16' between the valve needle 7 and the inner bore of the body in section 13.

The valve needle 7 is formed with a circular notch or groove 24 in the region of the ring duct 18. A shaft portion 25 is located between the groove or notch 24 and the conical tip 8. The diameter of the shaft portion 25 is less than the diameter of the long cylindrical section 17 so that the space 16' is available in that part of the injection valve body 6 which lies between the ring groove 18 and the tip. Fuel which is introduced in the portion between the ring duct 18 and the seat 9 in the valve body 6 can thus flow between the needle 7 and the inner walls of the valve body 6.

The funnel-shaped seat 9 in the body 6 is a valve seat surface; it must have substantial surface hardness. The rear half of the long cylindrical portion 17 which terminates in advance of the ring duct 18 guides the needle 7 and thus also must have substantial surface hardness. The valve body 6 is made of hardening steel having 0.2% carbon.

The highly loaded portions 17 and 9 of the central bore must have additional surface hardening; their surface must be carburized to a carbon content of 0.65%.

In accordance with the present invention, a mandrel 26 (FIG. 4) is used to carburize the inner surfaces of the opening which are to be hardened. The carbon content of the mandrel 26 can be determined from relationship (1 ), namely by considering that the carbon content of the carburized work piece will be the arithmetic mean of the carbon content of the uncarburized work piece and of the mandrel 26 before carburization. Substituting the respective values $$C_o = 0.2\%, C_k = 0.65\% \quad (3)$$

one obtains $$0.65 = (0.2 + C_D)/2, \text{ and}$$
$$C_D = 2 \times 0.65 - 0.2 = 1.1\% \text{ carbon content} \quad (4)$$

The mandrel 26 is pin-shaped and has a long cylindrical section 27 which has a diameter smaller by 0.2 mm than the diameter of the cylindrical section 17 in valve body 6. It is somewhat longer than the length of the section 17 in the valve body 6, so that, when the pin 26 is totally introduced into the central bore of the valve body, it projects somewhat from the outside of the valve body so that it can be readily introduced and, after carburization, can be readily removed from the central bore of the valve body 6.

The carburization element, that is, pin 26 has the cylindrical portion 27 and then terminates in a funnel-shaped tip 28 which corresponds to the bent, funnel-shaped surface 19 at the inner end of the valve body 6. The shapes and dimensions of the tip 28 are so selected that clearance of about 0.1 mm will exist between the pin 26 and the interior surface of the valve body at all locations.

Figure 4:
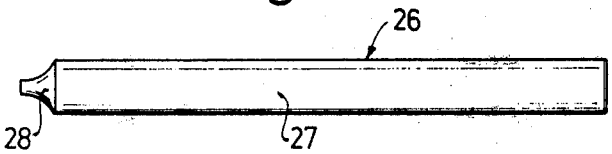
FIG. 4 is a side view of a carburizing body in form of a mandrel to carburize the bore of the fuel injection valve of FIG. 3.
Figure 5:
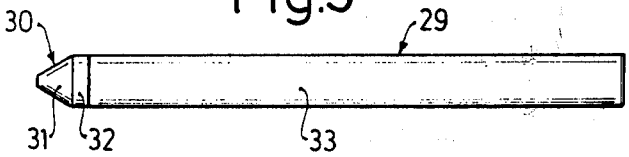
FIG. 5 is a side view of another embodiment of a carburizing element in which the element is composed of different sections with different carbon content for different carburization effects.

Manufacture of a funnel-shaped tip having an outline of a complex curve is comparatively expensive; as seen in FIG. 5, the pin 29 which has a cylindrical section 33 can be provided with a conical tip having a cone angle which is similar to the cone angle of the valve seat surface in body 6 at the mean or intermediate range of the reducing section forming the funnel-shaped surface 19. Such a conical tip is cheaper and easier to make than the shape of the complex funnel-shaped tip 28 of FIG. 4, and still permits carburization of the sealing surface, or valve seat of the valve body 6 which is almost the same as with a pin of the shape of FIG. 4. The conical surface will have an approximately similar distance between the tip of the pin and the sealing surface in the body 6 within the clearance dimension above referred to.

A typical dimension for an injection nozzle has a central opening 17 of a diameter of 5 mm; using a mandrel 26 or 29 of 4.8 mm has provided excellent results in tests, leaving a clearance of 0.1 mm between the mandrel and the inner surface of the bore. Tests have shown that this clearance dimension is practically independent of the diameter of the bore.

The pin 26 is formed of steel with 1.1% carbon. The time during which it is in the central bore in the body 6 causes carburization also at those surfaces which are not highly loaded, or highly subject to wear, that is, surfaces requiring less hardness than the valve seat surface 9 and the guide surface 17 for the needle 7. These inner surfaces which are not subjected to wear are, for example, the ring duct 18 with roughly semi-circular cross section, and the portion 16' of the central bore in body 6 which is not contacted by the valve needle 7 and which is provided for fuel flow.

The forward portion of the cylindrical section 17 is carburized to the same extent as the guide surface required to guide the needle 7, that is, the rear portion 17, since the surfaces of the pin 26 which yield carbon are of the same size as the cylindrical inner surfaces of the valve body 6 which accept carbon. Carburization of the inner surface of the ring duct 18 with the roughly semi-circular cross section is only half as extensive, however, as the carburization of the cylindrical inner surfaces in the valve body 6, since the surface area of the ring duct 18 is roughly twice the surface area as the surface area on pin 26 which yields the carbon.

If it is desired to carburize essentially only the valve seat surface 9, then a pin 29, as in FIG. 5, can be used. This pin — apart from the different tip shape — is made of several sections with material of different carbon content. The tip 30 has 1.1% carbon; this tip consists of a truncated cone 31, and a short cylindrical section 32. It is joined to a long cylindrical rear portion 33 which covers the rest of the length of the body 6, that is, essentially the operating length of the valve needle 7. The portion 33 has 0.2% carbon. This composite pin 29 can yield carbon only at the tip 30, so that only the tip 30 will reach the balance or equilibrium condition of 0.6% carbon content, yielding 0.6% carbon content, so that only the valve seat 9 of the valve body 6 will be carburized.

Composite pins or carburization elements having different carbon contents can be provided, so that different sections of bores into which these pins are inserted will be differently carburized.

The method in accordance with the present invention, as well as the carburization element, can also be used to carburize outer surfaces. If the outer surfaces are symmetrical with respect to rotation, then the carburization bodies can simply be sleeves having central bores, the inner surfaces of which correspond to the outer surfaces of the work piece. By use of sleeves of different carbon content along the length thereof — similar to the pin 29 of FIG. 5 — differently carburized surface portions can be formed on the work pieces.

The pin 5 (FIG. 1) or 26 may be made of steel, grey cast iron, or graphite; likewise, the tip 30 of the pin 29 (FIG. 5) may be made of one of those materials, rather than carbon containing steel, the content of which has been calculated as aforesaid in relationship (1).

Various changes and modifications may be made within the scope of the inventive concept.

Example of carburizing process: A valve body structure as shown in FIG. 2, with a carburizing mandrel as shown in FIG. 4 was placed in a furnace.

Temperature of the body and the mandrel was raised to: 950° C. When body and mandrel had the respective temperature, they were maintained at that temperature for: 2.5 hours. The composition of the mandrel steel was: 16 MnCr5 (DIN) Depth of carburization at the carburized zones: 0.5 mm.

If the mandrel is made of steel or iron, then it should not contain carbide-forming elements, or, if so, an excess of carbon so that free carbon will be available for the carburization process. Preferred steel compositions are: C 115 (DIN)

If the mandrel is made of graphite, the time and temperature during the carburization process will determine the extent and depth of carburization. For example, heating the work piece and the graphite to a temperature of 950° C for a time of 2.5 hours results in satisfactory carbon penetration of the surface layer to provide the hardened, carburized surface, having a depth of penetration of: 0.5 mm.

The process can only be carried out in an atmosphere which permits the formation of a gaseous carbonaceous substance, such as CO or $CH_4$. For example $O_2$ or $CO_2$ reacts with the carbon of the mandrel to CO, which carries the carbon to the adjacent work piece surface to carburize the work piece surface until the carbon concentration of the mandrel has been reached.

The carburizing body 5, 26, 29 can be re-used if the carbon content thereof can be re-activated, for example by re-carbonizing the manufactured and shaped body in a standard carburizing process using, for example, carbon powder as an external packing (or any other suitable method).

We claim:

1. A method of carburization hardening the steel surface of a valve seat situated in a bore of a steel valve body hardening of recesses which have a depth dimension which is including the steps of providing a carbon yielding carburizing body (5, 26, 29) in form of an elongated pin-like element having a shape at least approximately matching the shape of the valve seat to be carburized having a cross section which is slighty less than the corresponding cross section of the valve seat and bore, and which has a carbon content in the region where said valve seat is to be carburized which is higher than the carbon content of the steel to be carburized in the valve seat region of said valve body, in order to yield carbon to said valve seat region steel;

locating said carburizing pin-like element (5, 26, 29) within valve seat and bore closely adjacent to the valve seat region steel;

and heating the valve body and the pin-like element (5, 26, 29) inserted within the valve seat and bore thereof to glowing or incandescence temperature.

2. A method according to claim 1, wherein the size of the carburizing body is less by about 0.1 mm than the corresponding size of the bore in the valve body (1, 6) in which the carburizing body fits, to leave a clearance of said dimension of about 0.1 mm between the surface of the valve body to be carburized and said carburizing body.

3. A method according to claim 1, wherein said carburizing body has a carbon content which is determined, with respect to the carbon content of the uncarburized valve body, and the carbon content of the carburized surface by the relationship: $C_k = (C_o + C_D)/2$, wherein $C_o$ is carbon content of the valve seat region steel before carburization, in percent; $C_D$ is carbon content of the mandrel or carburizing element before carburization, in percent; and $C_k$ is carbon content of the valve seat region steel after carburization, in percent.

4. A method according to claim 1, wherein the carburizing body comprises an iron alloy.

5. A method according to claim 1, wherein the carburizing body comprises graphite.

6. A method according to claim 1, wherein the valve seat is rounded and funnel-shaped;

and wherein the carburizing body at the tip thereof is essentially conically shaped.

7. A method according to claim 1 wherein said valve body is a fuel injection valve-nozzle for an internal combustion engine from the outer surface by a distance which wherein the pin-like element has a diameter in the order of about 4.8 mm.

* * * * *